US010327493B2

(12) United States Patent
Robertson et al.

(10) Patent No.: US 10,327,493 B2
(45) Date of Patent: Jun. 25, 2019

(54) WIG HEAD WRAP

(71) Applicants: Yevonne Robertson, Sacramento, CA (US); Kiari Montgomery, Sacramento, CA (US); Imani Montgomery, Sacramento, CA (US)

(72) Inventors: Yevonne Robertson, Sacramento, CA (US); Kiari Montgomery, Sacramento, CA (US); Imani Montgomery, Sacramento, CA (US)

( * ) Notice: Subject to any disclaimer, the term of this patent is extended or adjusted under 35 U.S.C. 154(b) by 407 days.

(21) Appl. No.: 15/201,805

(22) Filed: Jul. 5, 2016

(65) Prior Publication Data

US 2018/0007987 A1 Jan. 11, 2018

(51) Int. Cl.
*A41G 3/00* (2006.01)

(52) U.S. Cl.
CPC ..... *A41G 3/005* (2013.01); *A41G 3/0016* (2013.01)

(58) Field of Classification Search
CPC .... A41G 3/005; A41G 3/0016; A41G 3/0008; A41G 3/0058; A41G 3/0041; A41G 3/00; A41G 3/0033; A41G 5/02; A41G 5/00; A41G 5/006; A41G 5/004; A41G 5/0053; A41G 5/0073; A41G 5/0093; A42B 1/241
See application file for complete search history.

(56) References Cited

U.S. PATENT DOCUMENTS 41,062 A * 1/1864 Edwards ..... A41G 3/0041 132/54
46,961 A * 3/1865 Walter ..... A41G 3/0041 132/54
1,518,049 A * 12/1924 Chocksee ..... A42B 1/041 2/200.1
3,862,638 A * 1/1975 Fannin ..... A41G 3/0016 132/53
4,165,542 A * 8/1979 McLaughlin ..... A42B 1/241 2/175.1
5,005,594 A 4/1991 Dunagan
5,860,165 A * 1/1999 Cvijanovich ..... A42B 1/066 2/172
5,988,177 A 11/1999 Bate
5,996,124 A * 12/1999 Asp, Jr. ..... A42B 1/241 2/172
6,317,892 B1 * 11/2001 Galigani ..... A42B 1/201 2/209.11
7,412,729 B1 8/2008 McGovern
(Continued)

*Primary Examiner* — Nicholas D Lucchesi
(74) *Attorney, Agent, or Firm* — Vincent G. LoTempio; Kloss, Stenger & LoTempio; David T. Stephenson

(57) ABSTRACT

A wig head wrap retains a wig in place on the head, and enables manipulation of the wig prior to mounting on the head. The wig head wrap includes a cap that encapsulates the head and hair while also accommodating an overlaying wig. The cap molds and fits closely on the head and hair of a person or doll. The wig fastens to the cap through sewing or adhesion. The wig may be manipulated to a desired fashion prior to the cap being fitted on the head. A pouch adjacently joins the cap. The pouch retains superfluous hair extending beyond the head, like a ponytail. The pouch can be adjusted towards the back of the head or at the top of the head to form a bun. A wig restraining cable retains the wig on the cap. A cap restraining cable helps retain the cap on the head.

20 Claims, 4 Drawing Sheets

(56) References Cited

U.S. PATENT DOCUMENTS

| | | | | |
|---|---|---|---|---|
| 8,991,406 | B1 * | 3/2015 | Salter | A41G 3/0016 132/201 |
| 10,021,929 | B1 * | 7/2018 | Kirschner | A41G 5/0093 |
| 2004/0139530 | A1 * | 7/2004 | Yan | A42B 1/067 2/209.13 |
| 2004/0168696 | A1 * | 9/2004 | Cox | A41G 3/0016 132/54 |
| 2006/0200889 | A1 * | 9/2006 | Newman | A42B 1/12 2/68 |
| 2013/0318687 | A1 * | 12/2013 | Bressler | A42B 1/241 2/209.13 |
| 2014/0109925 | A1 * | 4/2014 | Fisher | A41G 3/0041 132/54 |
| 2014/0202481 | A1 * | 7/2014 | Sato | A41G 3/005 132/54 |
| 2016/0113342 | A1 * | 4/2016 | Park | A41G 3/005 132/54 |
| 2016/0128411 | A1 * | 5/2016 | Ayres | A42B 1/241 2/172 |
| 2016/0174645 | A1 * | 6/2016 | Goldner | A41G 5/004 132/53 |
| 2016/0338437 | A1 * | 11/2016 | Couch | A41G 3/0041 |
| 2017/0265548 | A1 * | 9/2017 | Tao | A41G 3/0016 |
| 2017/0265549 | A1 * | 9/2017 | Tao | A41G 3/0016 |

* cited by examiner

WIG HEAD WRAP

FIELD OF THE INVENTION

The present invention relates generally to a wig head wrap for use under a wig to retain the wig in place and enable manipulation of the wig prior to mounting the wig on the head. More so, a wig head wrap provides a cap that encapsulates the head while also accommodating an overlaying wig; whereby the wig may be configured to a desired fashion prior to covering the head; whereby the cap encapsulates a substantial portion of the head and hair, while providing a surface for fastening the wig; whereby the head wrap further comprises a pouch that adjacently joins with the cap to encapsulate the portion of hair that extends beyond the head, while also providing a surface for fastening a secondary wig.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that a wig is a head covering made from human hair, animal hair, or synthetic fiber that is worn for fashion or other reasons, including cultural tradition and religious observance. Often, the use of a wig is cosmetic in that the user can don different hairstyles without having any changes made to their natural hair. The wig also serves to cover baldness, blemishes, and bad haircuts.

However, it is known that the wig does not always securely affix over the head and hair. Often, movement of the head reveals the presence of the wig and causes a very undesirable appearance. This can be because the interior of wigs is frequently rough. This is particularly so with wigs of artificial components. In many instances, a head cover is used beneath the wig. The head cover forms a barrier between the wig and the scalp, and also maintains wig cleanliness while also protecting the scalp from any harshness of the wig. In addition the head cover is useful to ventilate the scalp while being worn.

Those skilled in the art know that different techniques are used to secure a wig to the head of the person wearing the wig. If the wearer has hair, clipping the wig to the hair without use of a head cover is a reasonable technique. However, sometimes the available hair is so limited as not to provide an acceptable base for securing the wig. Further, since some heads are totally bald, an alternative technique is needed to secure the wig to the scalp of such persons. Sometimes double sided tape and glue compatible with human skin are used.

Another technique for affixing wigs to the head involve use of a band which is wrapped about the hairline or wherever the wig is to be worn meets the scalp. The band provides benefits. However, no barrier is provided between the scalp and the wig and the wig is secured to the band by hook and loop material. In either case, fashioning the wig prior to mounting on the head can be difficult.

It is advantageous to provide wig users with long or braided hair with an alternative way of covering their head prior to donning the wig. Presently, the user must braid long hair, or try to stuff long hair into a circular hair net, sometimes causing them to have to fight with the head cover in order to have it fit closely onto their head. This can be time consuming and uncomfortable.

Additionally, there is a need to re-wig the head of a doll, so as to provide multiple looks for the same doll. The current practice is that the user removes the existing dolls hair by pulling the hair off of the dolls head strand by strand. The user must then re-wig the head of the doll by purchasing a separate wig or hair piece, and finally gluing the new wig onto the head of the doll. This is cumbersome and involves use of toxic glues to adhere the new wig to the doll.

Other proposals have involved head wraps that are incorporated with wigs. The problem with these wig mounting techniques and devices is that they do not allow the wig to be fashioned or manipulated prior to mounting on the head. Also, they do not provide sufficient space for long or braided hair to be restrained beneath the wig. Even though the above cited wig mounting techniques and devices meet some of the needs of the market, a wig head wrap that retains a wig in place on the head, and enables manipulation of the wig prior to mounting on the head is still desired.

SUMMARY OF THE INVENTION

The present invention is directed to a wig head wrap that is configured to retain a wig in place on the head. The wig head wrap also serves to enable manipulation of the wig prior to mounting on the head. In one embodiment, the wig head wrap includes a cap that encapsulates the head while also accommodating the overlaying wig. The cap is configured to mold and fit closely on the head of a person or doll. The wig is configured to fasten to the cap through sewing, adhesion, or other mechanical means. In this manner, the cap serves to cover, conceal, and protect the natural hair and scalp from the wig. The wig may also be manipulated to a desired fashion prior to the cap being fitted on the head.

Further, a pouch adjacently joins the cap. The pouch retains the portion of the hair extending beyond the head, like a ponytail, bun, or other superfluous hair. The pouch can be adjusted towards the back of the head or at the top of the head to form a bun. A wig restraining cable helps retain the wig on the cap. A cap restraining cable helps retain the cap on the head.

One aspect of a wig head wrap, comprises:

a wig;

a cap, the cap defined by a cap mount surface and a cap wig surface, the cap mount surface configured to enable engagement with the head and the hair, the cap wig surface configured to enable attachment to the wig, whereby the cap and the attached wig are configured to generally follow the contour of the head and the hair, the cap further defined by a cap crown disposed generally in alignment with the crown of the head, the cap further defined by a cap body configured to at least partially encapsulate the head and the hair, the cap further defined by a cap base configured to form a cap opening, the cap opening configured to enable at least partial passage of the head and the hair into a cap cavity;

a pouch, the pouch defined by a pouch wig surface and a pouch base, the pouch base configured to form a pouch opening that leads into a pouch cavity, the pouch cavity configured to enable retention of a portion of the hair that extends beyond the head; and a junction member, the junction member disposed between the cap and the pouch, the junction member configured to join the cap base with the pouch base, whereby the pouch is configured to be manipulated along the cap base and the cap wig surface while retaining the portion of the hair that extends beyond the head.

In another aspect, the cap comprises a resilient material.

In another aspect, the cap comprises a generally mesh configuration.

In yet another aspect, the wig is configured to be sewn or glued to the cap wig surface.

In yet another aspect, the wig head wrap further comprises a secondary wig.

In yet another aspect, the pouch wig surface of the pouch is configured to enable fastening to the secondary wig.

In yet another aspect, the pouch comprises a plurality of apertures.

In yet another aspect, the portion of the hair that extends beyond the head comprises at least one of the following: a ponytail, a bun, a dreadlock, and a weave.

In yet another aspect, the junction member comprises at least one of the following: an elongated fabric, a hook and loop fastener, a zipper, and a button.

In yet another aspect, the wig head wrap comprises a wig restraining cable configured to extend across the cap base of the cap for helping to retain the wig on the cap.

In yet another aspect, the wig restraining cable is substantially elastic.

In yet another aspect, the wig head wrap comprises a fastener configured to fasten one end of the wig restraining cable.

In yet another aspect, the wig head wrap comprises a cap restraining cable configured to form a periphery around the cap base of the cap.

In yet another aspect, the cap restraining cable is substantially elastic.

It is one objective of the present invention to provide a wig head wrap that covers, conceals, and protects the natural hair and scalp from the wig.

It is another objective to provide a wig head wrap that retains the wig in place on the head.

It is another objective to enable manipulation of the wig prior to donning on the head.

It is another objective to encapsulate the head while also accommodating an overlaying wig.

It is another objective to create additional room for natural hair by providing a secondary pouch to retain superfluous natural hair without having to stuff all the natural hair into the cap.

Yet another objective is to provide a wig head wrap that molds and fits closely on the head of a person or doll.

Yet another objective is to provide a pouch that retains superfluous hair that extends beyond the head.

Yet another objective is to enable manipulation of the wig to a desired fashion prior to the wig head wrap being fitted on the head.

Yet another objective is to provide children an alternative option to re-wigging a dolls hair.

Yet another objective is to enable interchangeability of multiple wigs on the cap and pouch.

Yet another objective is to negate the need for toxins found in glues that are used to adhere a wig to the head of a doll.

Yet another objective is to save users money by refreshing the look of a doll without purchasing new dolls to achieve a new look.

Yet another objective is to apply and detach a dual compartmentalized wig on a doll, as oppose to applying and detaching a single compartment wig which will ultimately give the child more ease due to the additional space.

Yet another objective is to enable the doll to be customized with a wig that reflects diverse ethnic looks and fashions.

Yet another objective is to provide an inexpensive to manufacture head wrap.

In some embodiments, the wig head wrap comprises a cap and an adjoining pouch. The wig head wrap also comprises a wig, and in some embodiments, a secondary wig. The wig overlays and fastens to the cap. In some embodiments, a secondary wig may also overlay and fasten to the pouch. The wig may be manipulated to achieve a specific configuration, fashion, or shape prior to mounting the cap on the head. In this manner, the wig achieves a desired fashion before attachment to the head. For example, upon arrangement of the wig in the desired braided weave, the cap with the attached weave is fitted on the head. The pouch is configured to encapsulate superfluous natural hair that extends beyond the head, while also remaining attached to the cap. A secondary wig may also fasten to the pouch. The secondary wig may be moved in relation to the wig to achieve a desired look.

In some embodiments, the cap encapsulates a substantial portion of the head and natural hair across a cap mount surface. The cap also includes a cap wig surface that enables the wig to fasten to the cap. The cap is sufficiently resilient, so as to encapsulate the head, and the overlaying hair that is growing on, or affixed to the head. In some embodiments, the cap may have a mesh surface that provides ventilation and allows for easier fastening of the wig thereto.

In one embodiment, the cap comprises a cap crown that aligns with the crown of the head. The cap further comprises a cap body that encapsulates the head. The cap further comprises a cap base that forms the circumferential termination of the cap body. The cap base forms a cap opening to enable passage of the head. In some embodiments, a cap restraining cable may form a periphery around the cap base, applying a tension around the head that helps retain the cap on the head. Further, a wig restraining cable extends across the cap base. The wig restraining cable is configured to help retain the wig on the cap wig surface of the cap.

In an alternative embodiment, the wig does not permanently fasten to the cap. Rather, multiple wigs may be interchanged to fasten to the first and pouch wig surface. This interchangeability allows the head wrap to have a more personalized look. For example, a user may sew a personal wig onto the cap.

The pouch adjacently joins with the cap at a junction member. The pouch may be disposed to orient towards the rear direction of the head, opposite the face. The pouch may include a pouch base configured to form a pouch opening that leads into a pouch cavity. The pouch cavity is configured to enable retention of the portion of the hair that extends beyond the head, such as a ponytail, bun, weave, or other superfluous hair. The pouch may include a pouch wig surface that enables the attachment of a secondary wig. In one embodiment, the pouch is substantially smaller than the cap. Unlike cap, the pouch does not require shaping and molding to head, and thus may take a more irregular shape and size than the cap.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
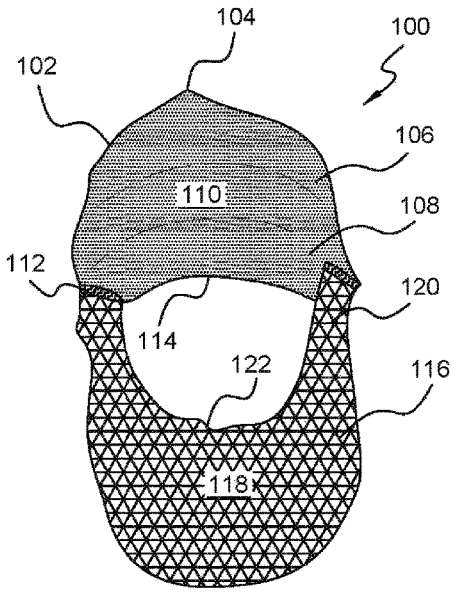
FIG. 1 illustrates a front perspective of an exemplary wig head wrap, in accordance with an embodiment of the present invention.

FIGS. 1-9 illustrate exemplary embodiments of a wig head wrap 100. Wig head wrap 100 is configured to help retain a wig 300 in place on the head 200. Wig head wrap 100 also serves to enable manipulation of wig 300 prior to mounting on the head 200. As illustrated in FIG. 1, wig head wrap 100 comprises a cap 102 and an adjoining pouch 116. Wig head wrap 100 may also comprise a wig 300, and in some embodiments, a secondary wig 302. Wig 300 may fixedly or detachably attach to cap 102. In one exemplary use of wig head wrap 100, the wig 300 is manipulated to a desired fashion prior to mounting cap 102 and wig 300 onto head 200.

Figure 2:
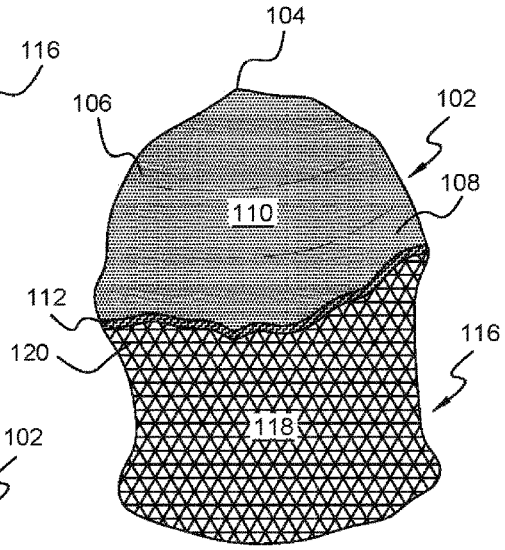
FIG. 2 illustrates a rear perspective of the wig head wrap shown in FIG. 1, in accordance with an embodiment of the present invention.

As FIG. 2 shows, cap 102 encapsulates the head 200 while also accommodating the wig 300. Cap 102 is sufficiently resilient, so as to encapsulate both head 200, and hair 202 that is growing on, or affixed to the head 200. In some embodiments, cap 102 is generally shaped to fit a human head or a doll head, so as to form a natural look and feel. In this manner, wig head wrap 100 serves to cover, conceal, and protect natural hair, artificial hair, and the scalp from the wig 300. For example, cap 102 may shrink and mold around the head of a doll or human having long hair in order to apply wig 300 to the head 200. Cap comfortable retains the long hair to enable accurate fitting of wig 300 on head 200.

Figure 5:
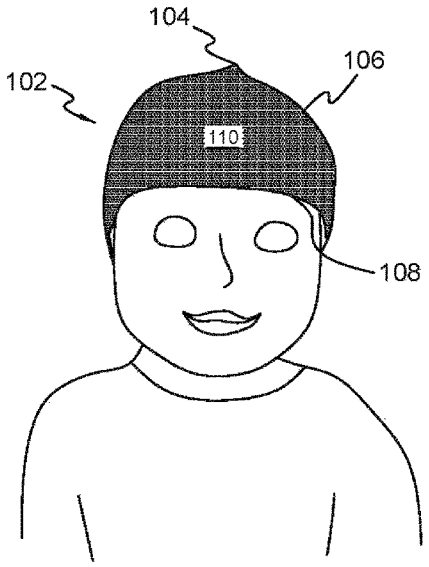
FIG. 5 illustrates a front perspective of the head shown in FIG. 4 covered by an exemplary cap, in accordance with an embodiment of the present invention.

Turning now to FIG. 5, cap 102 encapsulates a substantial portion of the head 200 and hair 202 across a cap mount surface (not shown). The cap mount surface is configured to provide comfortable contact with the head, scalp, and natural hair. In some embodiments, the cap 102 may have a generally mesh configuration that provides ventilation to the head 200, and also facilitates fastening of the wig 300 to cap 102.

Figure 4:
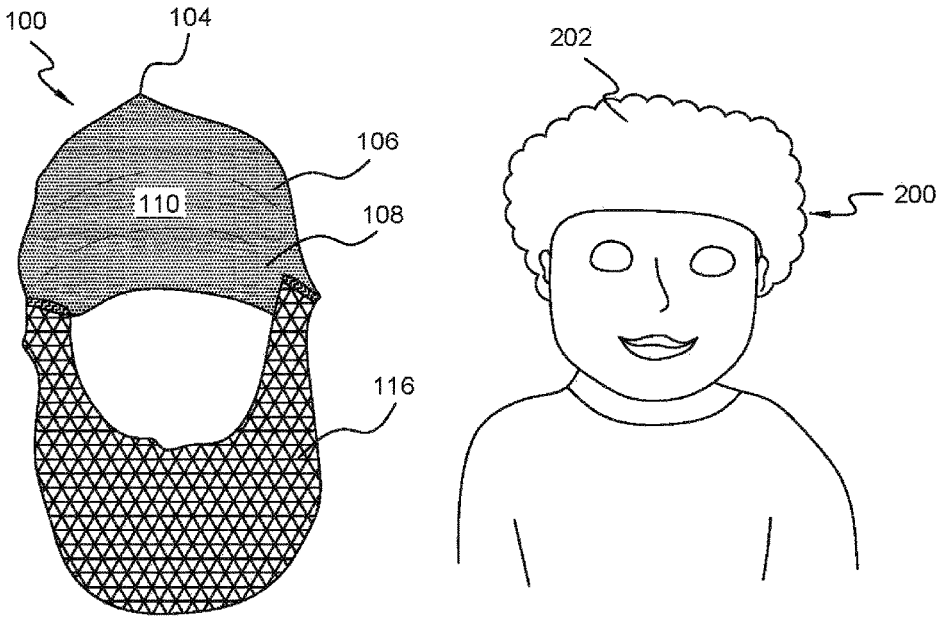
FIG. 4 illustrates a front perspective of the wig head wrap shown in FIG. 1 adjacent to a head having natural hair, in accordance with an embodiment of the present invention.

Looking at FIG. 4, cap 102 also includes a cap wig surface 110 that enables wig 300 to fasten and manipulate to cap 102. In some embodiments, wig 300 may be configured to fasten to cap wig surface 110 through sewing, weaving, mechanical fastening, or adhesion. In some embodiments, wig 300 fixedly joins the cap wig surface 110; whereby the wig 300 integrates into the cap 102. Though in other embodiments, wig 300 detachably attaches to the cap wig surface 110, serving as a separate component.

One advantage provided by cap 102 is that the wig 300 may be manipulated to a desired fashion prior to the cap 102 being fitted on head 200. For example, wig 300 may be braided or beaded by a user, and then self-mounted on the head 200 by the same user. Those skilled in the art will recognize that, otherwise, a user with long hair would have to braid the long hair, or try to stuff the long hair in a circular hair net. This could cause the user to struggle while stuffing the long hair into a circular hair net. The capacity to prepare the wig 300 prior to mounting on the head 200, as the present invention allows, helps prevents this problem.

Or in another exemplary use, wig 300 may be fashioned to a desired look for the head of a doll prior to affixing the cap 102 and attached wig to the doll. This is advantageous for creating a fresh look to the doll without having to purchase additional dolls; or even creating an ethnic look to the doll that may not be available for purchase.

Yet another exemplary use is provided for children to re-wig the hair on a doll. Presently, the existing hair of the doll is removed by physically pulling the hair off the head of the doll, and then re-wigging the hair by purchasing a separate wig or hair piece. Finally, the wig is glued onto the head of the doll. This process is tedious and exposes the child to toxic glues. The present invention helps prevent this problem by allowing the wig 300 to be manipulated to a desired fashion prior to mounting the head of the doll.

In an alternative embodiment, wig 300 does not permanently fasten to cap 102. Rather, multiple wigs may be interchanged to fasten to the cap wig surface 110. This interchangeability allows wig head wrap to have a more personalized look. For example, a user may sew a personal wig that is braided, beaded, or dyed to the cap 102.

Turning back to FIGS. 1 and 2, cap 102 comprises a cap crown 104 that aligns with the crown of the head. Cap 102 further comprises a cap body 106 that encapsulates the head. Cap 102 further comprises a cap base 108 that forms the circumferential termination of the cap body 106. Cap base 108 forms a cap opening 114 to enable passage of the head 200. Cap base 108 is sufficiently sized and dimensioned to receive a human head, or in some embodiments, a doll head.

Figure 3:
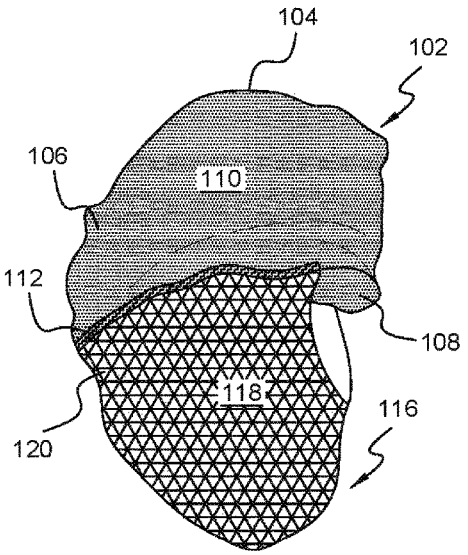
FIG. 3 illustrates a right side perspective of the wig head wrap shown in FIG. 1, in accordance with an embodiment of the present invention.

As FIG. 3 shows, a cap restraining cable 404 may form a periphery around the cap base 108. Cap restraining cable 404 is configured to apply an inward tension around the head 200 that helps retain the cap 102 on the head 200. Further, the wig head wrap 100 may also include a wig restraining cable 400 that extends across the cap base 108. The wig restraining cable 400 is configured to help retain the wig on the cap wig surface 110 of the cap 102. A fastener 402, such as an eyelet and hook, may be used to fasten one end of the wig restraining cable 400 to cap base 108. Both cap restraining cable 404 and wig restraining cable 400 may be fabricated from a substantially elastic material.

In some embodiments, a pouch 116 may join with cap 102. Pouch 116 adjacently joins with the cap 102 at a junction member 112. Junction member 112 may include, without limitation, an elongated fabric, a hook and loop fastener, a zipper, and a button. In one embodiment, pouch 116 extends along the length of a rear end of the cap 102. Pouch 116 may be disposed to orient towards the rear direction of the head, opposite the face. In one embodiment, pouch 116 is substantially smaller than cap 102. Unlike cap 102, the pouch 116 does not require shaping and molding to head 200, and thus may take a more irregular shape and size than the cap 102.

Figure 8:
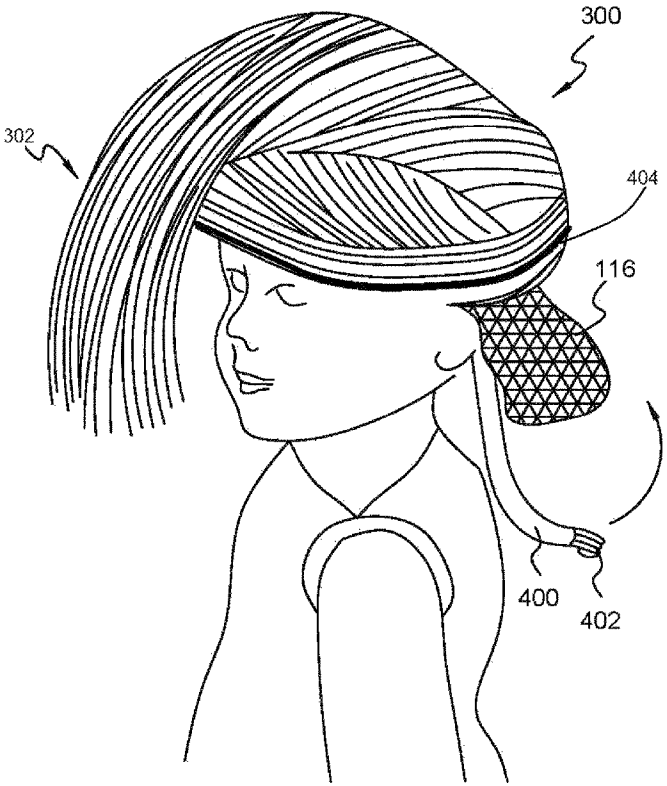
FIG. 8 illustrates a side perspective of the cap shown in FIG. 4 with an exemplary wig, and the pouch shown in FIG. 4 with an exemplary secondary wig, in accordance with an embodiment of the present invention.

FIG. 8 illustrates that pouch 116 is configured, primarily to help retain a portion of the hair 204 that extends beyond the head, like a ponytail, a weave, a braid, a bun, and other superfluous portions of hair. This additional compartment to retain this superfluous portion of hair 204 creates greater space and comfort while donning the wig head wrap 100, since the entirety of hair does not have to be fit under cap 102.

Figure 6:
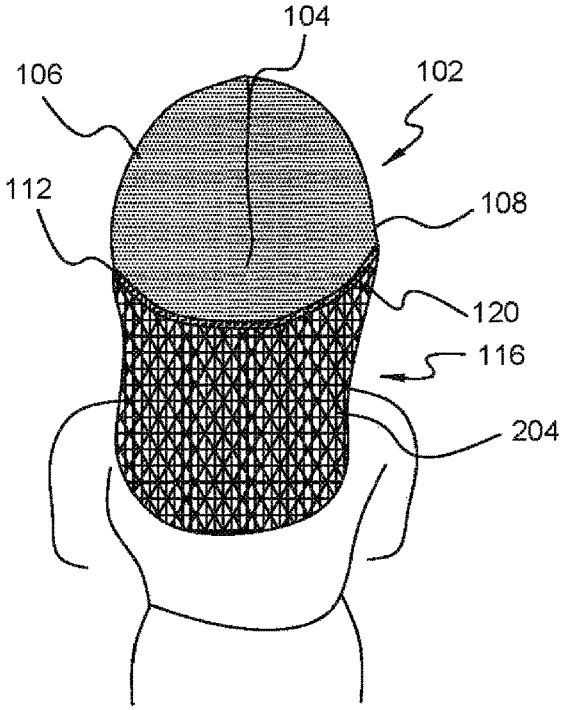
FIG. 6 illustrates a rear perspective of the head covered by the cap shown in FIG. 4, in accordance with an embodiment of the present invention.
Figure 7:
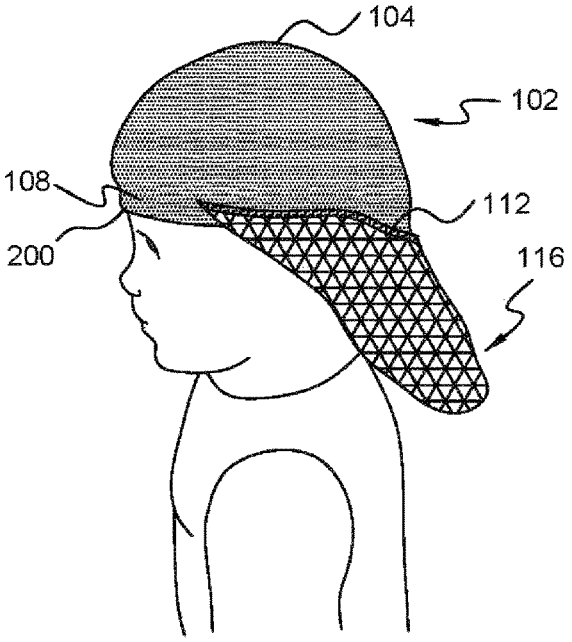
FIG. 7 illustrates a left side perspective of the head covered by the cap shown in FIG. 4, in accordance with an embodiment of the present invention.

As referenced in the head and hair shown in FIG. 4, pouch 116 may include a pouch base 120 configured to form a pouch opening 122 that leads into a pouch cavity (not shown). Pouch cavity is configured to enable retention of the portion of hair 202 that extends beyond the head. Pouch 116 may also include a plurality of apertures that create a large mesh configuration. The large mesh configuration is shown in FIGS. 6 and 7. The large apertures are evenly spaced-apart and enable viewing of the portion of hair 204 that extends beyond the head. Pouch 116 is generally smaller than cap 102, and does not fully engage the head 200 like cap 102.

Figure 9:
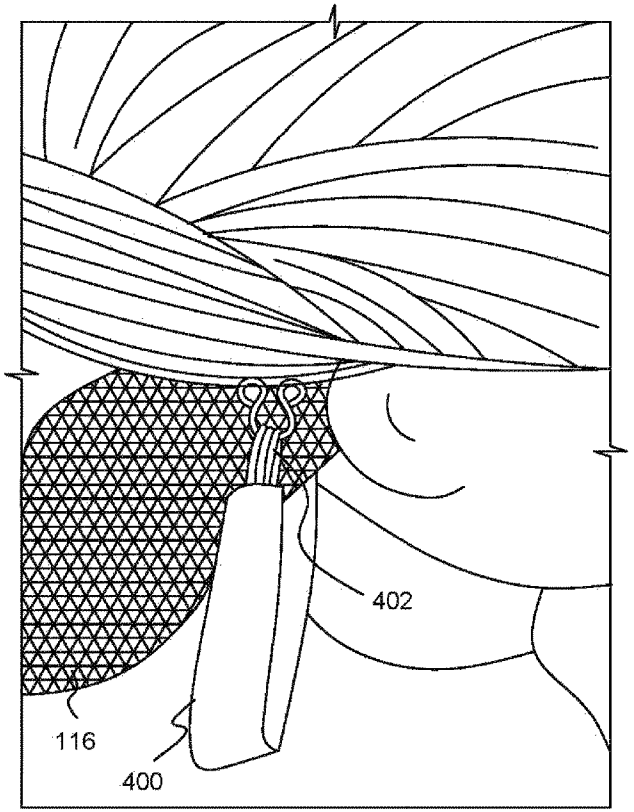
FIG. 9 illustrates a side perspective of the cap and the pouch shown in FIG. 8 with an exemplary wig retraining cable and an exemplary cap restraining cable, in accordance with an embodiment of the present invention.

As referenced in FIG. 9, a secondary wig 302 may overlay and fasten to pouch 116. Pouch 116 may include a pouch wig surface 118 for enabling the attachment and manipulation of a secondary wig 302. In some embodiments, secondary wig 302 may be configured to fasten to pouch wig surface 118 through sewing, weaving, mechanical fastening, or adhesion. The apertures of the pouch 116 allow the secondary wig 302 to be easily sewn into pouch 116.

Similar to the wig 300, the secondary wig 302 may be manipulated to achieve a specific configuration on the pouch 116 prior to orienting the pouch 116 relative to the cap 102. In this manner, the secondary wig 302 achieves a desired fashion before attachment to the head 200. While attached to cap 102, the pouch 116 can be adjusted towards the back of the head 200 or at the top of the head 200 to form a bun. In this manner, secondary wig 302 can be manipulated to a desired position relative to wig 300. For example FIG. 6 shows that upon arrangement of the wig 300 and the secondary wig 302 in the desired fashion, cap 102 is fitted to the head 200, and pouch 116 is oriented towards the back or the top of cap 102.

These and other advantages of the invention will be further understood and appreciated by those skilled in the art by reference to the following written specification, claims and appended drawings.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What we claim is:

1. A wig head wrap, the head wrap comprising:

a wig;

a cap, the cap defined by a cap mount surface and a cap wig surface, the cap mount surface configured to enable engagement with a head and hair, the cap wig surface configured to enable attachment to the wig, whereby the cap and the wig are configured to generally follow the contour of the head and the hair, the cap further defined by a cap crown adapted to be disposed generally in alignment with the crown of the head, the cap further defined by a cap body configured to at least partially encapsulate the head and the hair, the cap further defined by a cap base configured to form a cap opening, the cap opening configured to enable at least partial passage of the head and the hair into a cap cavity;

a pouch, the pouch defined by a pouch wig surface and a pouch base, the pouch base configured to form a pouch opening that leads into a pouch cavity, the pouch cavity configured to enable retention of a portion of the hair that extends beyond the head; and a junction member, the junction member disposed between the cap and the pouch, the junction member configured to join the cap base with the pouch base, whereby the pouch is configured to be manipulated along the cap base and the cap wig surface while retaining the portion of the hair that extends beyond the head.

2. The head wrap of claim 1, wherein the cap comprises a resilient material.

3. The bead wrap of claim 1, wherein the cap comprises a generally mesh configuration.

4. The head wrap of claim 1, wherein the wig is configured to be sewn or glued to the cap wig surface of the cap.

5. The head wrap of claim 1, further including a secondary wig.

6. The head wrap of claim 5, wherein the pouch wig surface of the pouch is configured to enable attachment to the secondary wig.

7. The head wrap of claim 1, wherein the pouch comprises a plurality of apertures.

8. The head wrap of claim 1, wherein the portion of the hair that extends beyond the head comprises at least one of the following: a ponytail, a bun, a dreadlock, and a weave.

9. The head wrap of claim 1, wherein the junction member comprises at least one of the following: an elongated fabric, a hook and loop fastener, a zipper, and a button.

10. The head wrap of claim 1, further including a wig restraining cable configured to extend across the cap base of the cap for helping to retain the wig on the cap.

11. The head wrap of claim 10, wherein the wig restraining cable is substantially elastic.

12. The head wrap of claim 11, further including a fastener configured to fasten one end of the wig restraining cable.

13. The head wrap of claim 1, further including a cap restraining cable configured to form a periphery around the cap base of the cap.

14. The head wrap of claim 13, wherein the cap restraining cable is substantially elastic.

15. A wig head wrap, the head wrap comprising:

a wig;

a cap, the cap defined by a cap mount surface and a cap wig surface, the cap mount surface configured to enable engagement with a head and hair, the cap wig surface configured to enable attachment to the wig, whereby the cap and the wig are configured to generally follow the contour of the head and the hair, the cap further defined by a cap crown adapted to be disposed generally in alignment with the crown of the head, the cap further defined by a cap body configured to at least partially encapsulate the head and the hair, the cap further defined by a cap base configured to form a cap opening, the cap opening configured to enable at least partial passage of the head and the hair into a cap cavity;

a secondary wig;

a pouch, the pouch defined by a pouch wig surface and a pouch base, the pouch wig surface of the pouch configured to enable attachment to the secondary wig, the pouch base configured to form a pouch opening that leads into a pouch cavity, the pouch cavity configured to enable retention of a portion of the hair that extends beyond the head; and a junction member, the junction member disposed between the cap and the pouch, the junction member configured to join the cap base with the pouch base, whereby the pouch is configured to be manipulated along the cap base and the cap wig surface while retaining the portion of the hair that extends beyond the head.

16. The head wrap of claim 15, further including a wig restraining cable configured to extend across the cap base of the cap for helping to retain the wig on the cap.

17. The head wrap of claim 16, wherein the wig restraining cable is substantially elastic.

18. The head wrap of claim 17, further including a fastener configured to fasten one end of the wig restraining cable.

19. The head wrap of claim 15, further including a cap restraining cable configured to form a periphery around the cap base of the cap.

20. A wig head wrap, the head wrap comprising:

a wig;

a cap, the cap defined by a cap mount surface and a cap wig surface, the cap mount surface configured to enable engagement with a head and hair, the cap wig surface configured to enable attachment to the wig, whereby the cap and the wig are configured to generally follow the contour of the head and the hair, the cap further defined by a cap crown adapted to be disposed generally in alignment with the crown of the head, the cap further defined by a cap body configured to at least partially encapsulate the head and the hair, the cap further defined by a cap base configured to form a cap opening, the cap opening configured to enable at least partial passage of the head and the hair into a cap cavity;

a secondary wig;

a pouch, the pouch defined by a pouch wig surface and a pouch base, the pouch wig surface of the pouch configured to enable attachment to the secondary wig, the pouch base configured to form a pouch opening that leads into a pouch cavity, the pouch cavity configured to enable retention of a portion of the hair that extends beyond the head;

a junction member, the junction member disposed between the cap and the pouch, the junction member configured to join the cap base with the pouch base, whereby the pouch is configured to be manipulated along the cap base and the cap wig surface while retaining the portion of the hair that extends beyond the head;

a wig restraining cable, the wig restraining cable configured to extend across the cap base of the cap for helping to retain the wig on the cap;

a fastener, the fastener configured to fasten one end of the wig restraining cable; and a cap restraining cable configured to form a periphery around the cap base of the cap.

* * * * *